US011110484B2

(12) United States Patent
Deegan

(10) Patent No.: US 11,110,484 B2
(45) Date of Patent: Sep. 7, 2021

(54) DISPENSING PAINTBRUSH

(71) Applicant: Kudachi Business Consultants, LLC, Prescott, AZ (US)

(72) Inventor: Michael Deegan, Prescott, AZ (US)

(73) Assignee: Kudachi Business Consultants, LLC, Prescott, AZ (US)

( * ) Notice: Subject to any disclaimer, the term of this patent is extended or adjusted under 35 U.S.C. 154(b) by 0 days.

(21) Appl. No.: 16/948,344

(22) Filed: Sep. 14, 2020

(65) Prior Publication Data

US 2021/0078033 A1 Mar. 18, 2021

Related U.S. Application Data

(60) Provisional application No. 62/899,271, filed on Sep. 12, 2019.

(51) Int. Cl.
*A46B 11/06* (2006.01)
*B05C 17/01* (2006.01)

(52) U.S. Cl.
CPC ..... *B05C 17/0146* (2013.01); *A46B 11/063* (2013.01); *A46B 2200/202* (2013.01)

(58) Field of Classification Search
CPC ..... A46B 11/06–066; B05C 17/002
See application file for complete search history.

(56) References Cited

U.S. PATENT DOCUMENTS 2,493,480 A * 1/1950 Eisner ..... A46B 11/063 401/281
2,528,599 A * 11/1950 Loether ..... A46B 11/063 401/290
2,553,381 A * 5/1951 Renne ..... A46B 11/063 401/279
2,816,306 A * 12/1957 Davis ..... A46B 11/063 401/271

* cited by examiner

*Primary Examiner* — Paul R Durand
*Assistant Examiner* — Randall A Gruby
(74) *Attorney, Agent, or Firm* — Weide & Miller, Ltd.

(57) ABSTRACT

A dispensing paintbrush includes a handle, a brush head connected to the handle, and bristles attached to the brush head to apply a fluid to a surface. A coupler is attached to the handle and is configured to connect to a fluid source. A nozzle is attached to the coupler and is configured to dispense the fluid to the bristles. The nozzle extends within the bristles and terminates at a position from the brush head that is less than one half the length of the bristles.

5 Claims, 4 Drawing Sheets

DISPENSING PAINTBRUSH

CROSS-REFERENCE TO RELATED APPLICATION

This application claims the benefit of U.S. Provisional Application No. 62/899,271, which was filed on Sep. 12, 2019, the contents of which are hereby incorporated by reference.

BACKGROUND

Conventional paintbrushes include a handle end for holding and controlling the brush and a bristle end for contacting and applying paint to a surface. A painter will conventionally dip or otherwise externally apply paint to the bristle end and then move the paintbrush to the surface to be painted. The painter then moves the brush along the surface to transfer the paint from the brush to the surface. The process is repeated until the surface is covered. The process of painting, and especially in the transfer of paint from a paint source such as a paint can to the brush and then to the transfer from the brush to the final surface may be messy and time consuming. Paint may drip from the brush as it is moved between the paint source and the surface to be painted. Application of the paint to the surface is usually done at different locations and heights from the surface to be painted. The painter therefore usually bends down, walks, or otherwise moves their body to transition between locations. Such actions are time consuming and tiring.

SUMMARY

Exemplary embodiments described herein allow for easier application of paint onto a surface using a paint brush and include methods and systems for applying a fluid to a brush and/or to a surface.

According to one exemplary embodiment, a dispensing brush includes a handle, a brush head connected to the handle, and bristles attached to the brush head to apply a fluid to a surface. A coupler may be attached to the handle and may be configured to connect to a fluid source. A nozzle may be attached to the coupler and may be configured to dispense the fluid to the bristles. The nozzle may extend within the bristles and may terminate at a position from the brush head that is less than one half the length of the bristles.

In some embodiments, the dispensing brush further includes a ferrule surrounding first ends of the bristles to retain the bristles together. The nozzle within the bristles may include a narrow dispenser that is disposed in the brush head. The coupler may be configured to freely rotate about the brush head.

In other embodiments, the coupler is disposed between the bristles and the handle of the brush. The coupler may include an attachment point that connects to the fluid source. The attachment point may extend from the coupler in a direction substantially perpendicular to the bristles of the brush.

The brush head may be connected to the handle via a pivoting connection allowing rotation of the handle relative to the brush head. An actuated lock may be provided that is configured to selectively lock and unlock to allow and stop the relative rotation of the handle relative to the brush head. In some instances, the coupler includes a flow control valve to vary the flow of paint to the bristles. Additionally, the handle may have a trigger to start and stop the flow of the fluid to the bristles. The trigger may be disposed opposite the coupler on the handle.

In some embodiments, the handle may have a retaining ring to selectively connect the brush head to the handle. In this manner, the brush head may be disposable. The retaining ring may also facilitate rotation of the brush head relative to the handle.

In another exemplary embodiment, a dispensing brush is provided that has a handle, a brush head connected to the handle, and bristles attached to the brush head where the bristles are configured to apply a fluid to a surface. A coupler may be attached to and end of the handle adjacent to the brush head, and may extend in a direction substantially perpendicular to the bristles. The coupler may be configured to connect to a fluid source. A nozzle may be attached to the coupler and may be configured to dispense the fluid to the bristles.

In some embodiments, the coupler may have a flow control valve. Additionally, the handle may include a trigger to start and stop the flow of the fluid to the bristles. The trigger may be disposed opposite the coupler on the handle.

The handle may have a retaining ring to selectively connect the brush head to the handle. The retaining ring may also facilitate rotation of the brush head relative to the handle. The nozzle may extend within the bristles and may terminate at a position from the brush head that is less than one half a length of the bristles.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

The following detailed description illustrates by way of example, not by way of limitation, the principles of the various embodiments of the invention. This description will clearly enable one skilled in the art to make and use the invention, and describes several embodiments, adaptations, variations, alternatives and uses. It should be understood that the drawings are diagrammatic and schematic representations of exemplary embodiments, and are not limiting of the present invention nor are they necessarily drawn to scale.

Exemplary embodiments include a brush having bristles for applying a fluid to a surface and a dispenser with at least a portion of the dispenser positioned within the bristles.

Although embodiments may be described and illustrated herein in terms of a paintbrush, it should be understood that embodiments of this invention are not so limited but are additionally applicable to other dispensing applications. For example, applications may be used for dispensing colorants or other substance to a hairbrush for dying hair. Alternatively, other substances besides paint, colorants, or dyes may be dispersed through the brush, such as water or other cleaner for cleaning the brush and/or another surface. The brush may therefore, for example, be a cleaning brush.

Figure 1:
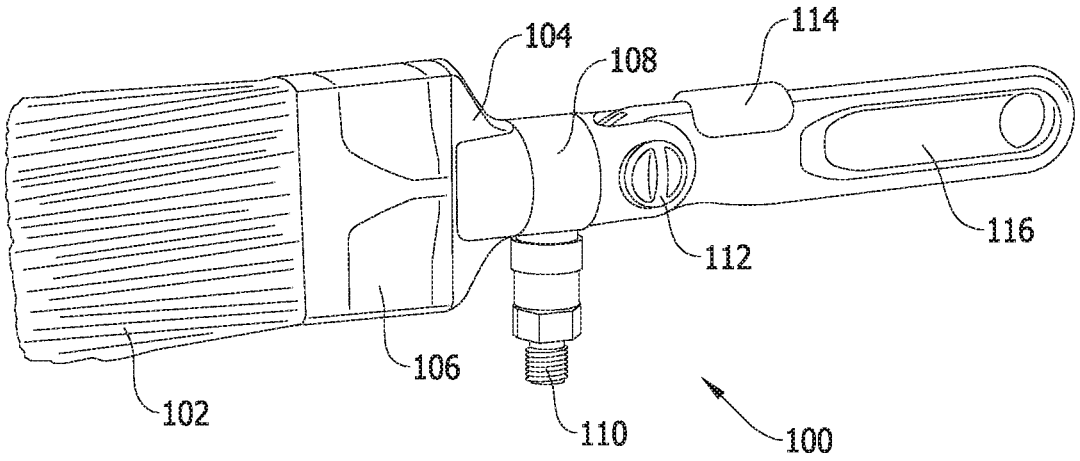
FIG. 1 illustrates a dispensing paintbrush according to an exemplary embodiment.

FIG. 1 illustrates a dispensing paintbrush according to one exemplary embodiment. A dispensing paintbrush 100 comprises bristles 102 that are attached to a paintbrush head 104. The paintbrush head 104 may comprise a ferrule 106 to hold the bristles 102 in place, such as during the manufacturing process. The ferrule 106 may be formed of any suitable material. In some embodiments, the ferrule 106 may be constructed from sheet metal comprised of an aluminum alloy which is formed into the shape shown in the figures. The bristles 102 may be similar to bristles used on a conventional paintbrush. The bristles 102 may be formed from natural materials such as hogs hair or camel hair, or the bristles 102 may be formed from synthetic fibers such as nylon or polyester.

The dispensing paintbrush 100 further comprises an inlet coupler 108. The inlet coupler is configured to be free rotating about the brush head 104. This allows the user to easily orient the paintbrush 100 during use. The inlet coupler 108 includes an attachment point 110 for connecting to a paint compressor. The attachment point 110 may be any standard attachment such as a threaded attachment, a quick connect, or the like. In some embodiments, the inlet coupler 108 comprises a flow control valve that allows a user to adjust the flow of paint from the paint compressor to the bristles 102 of the paintbrush 100.

As shown in the figures, the coupler 108 surrounds the brush head 104 or at an end of a handle 116 adjacent to the brush head so as to be disposed at an intermediate position with respect to the dispensing paintbrush 100. The attachment point 110 of the inlet coupler 108 extends in a direction that is substantially perpendicular to the bristles 102 of the paintbrush 100. The rotation, positioning, and orientation of the inlet coupler 108 allows the user to easily manage piping coming from the paint compressor to the paintbrush 100 during use.

The handle 116 may be an adjustable handle and is connected to the brush head. The handle 116 may be formed from any suitable material. For example, the handle 116 may be molded from a polymer-based material. In another embodiment, the handle may be cast from an aluminum material and may be anodized as part of a finishing process. In some embodiments, the handle 116 may be covered with a non-slip grip.

Figure 2:
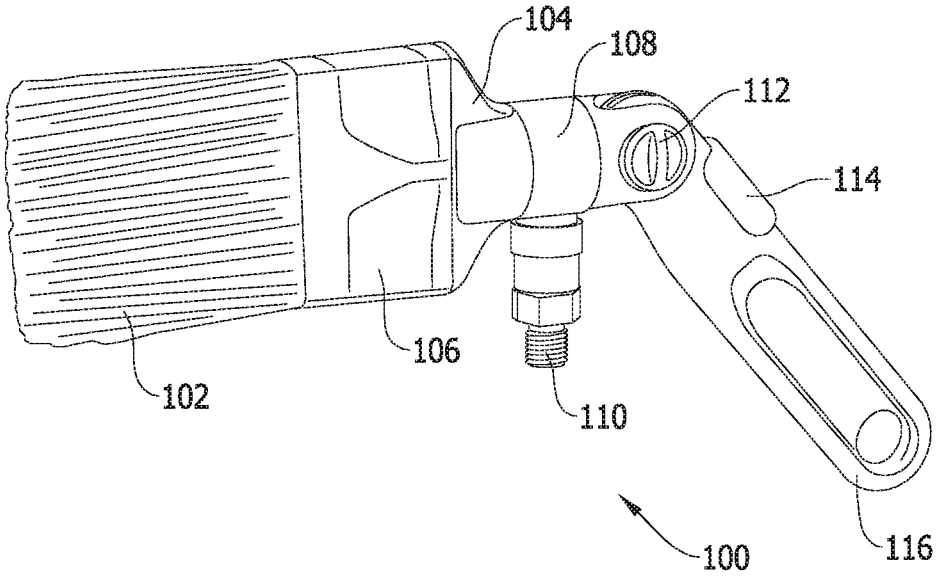
FIG. 2 illustrates a dispensing paintbrush with an adjustable handle according to an exemplary embodiment.

As shown in FIG. 2, the handle 116 may be adjustable and may pivot from a first position to a second position relative to the brush head 104. The handle 116 connects to the inlet coupler 108 via a pivoting connection 112. In order to prevent pivoting of the handle 116 relative to the coupler 108 and brush head 104 during use, an actuator 114 may be provided that locks the handle 116 relative to the coupler 108 and brush head 104. For example, the actuator 114 may be biased into a lock position and may be actuated by the user such as by using a finger to push or pull the actuator 114 to move the actuator into an unlocked position which allows rotation of the handle 116 relative to the brush head 114.

In other embodiments, the handle 116, the coupler 108, and the brush head 104 may be formed in a rigid construction where the handle 116 does not pivot relative to the coupler 108 and brush head 104. In this instance, the handle 116 and brush head 104 may be formed from a single piece.

Figure 3:
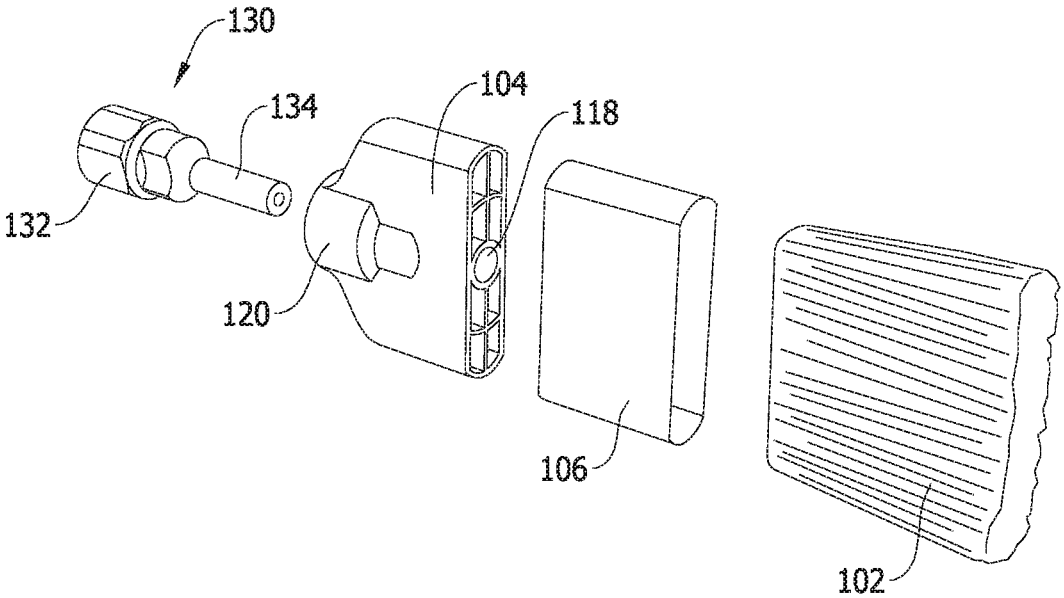
FIG. 3 illustrates an exploded view of a dispensing paintbrush according to an exemplary embodiment.

FIG. 3 illustrates an exploded view of a dispensing paintbrush according to one exemplary embodiment. As shown in FIG. 3, the dispensing paintbrush 100 comprises a nozzle 130. The nozzle 130 comprises a nozzle body 132 that is connected to the inlet coupler 108 (FIGS. 1 and 2) and receives the paint from the inlet coupler 108. The nozzle body 132 is formed to include a narrow dispenser 134 at a terminal end. The nozzle 130 is configured to direct the flow of paint from the inlet coupler 108 through the narrow dispenser to the bristles 102 to load the bristles 102 with paint during use. The nozzle 130 may also transport other cleaning liquids to the bristles 102, such as water or a paint thinner.

The brush head 104 may comprise a nozzle attachment 120 that receives the nozzle 130. The nozzle attachment 120 may comprise a fitting to attach to the nozzle 130 such as via threads, a quick connect attachment device, or the like. In some instances, this may allow the brush head 104 to be removable from the nozzle 130, coupler 108 and handle 116. This facilitates easier clean up when completing a job. In some instances, the brush head 104 may be disposable. Thus, a new brush head 104 may be attached for each use of the dispensing paintbrush 100.

Figure 4A:
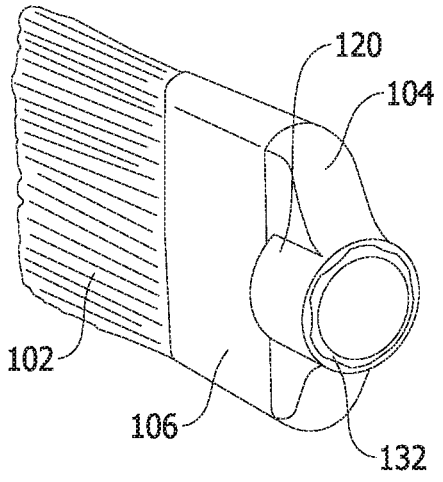
FIG. 4A illustrates a brush head for a dispensing paintbrush.
Figure 4B:
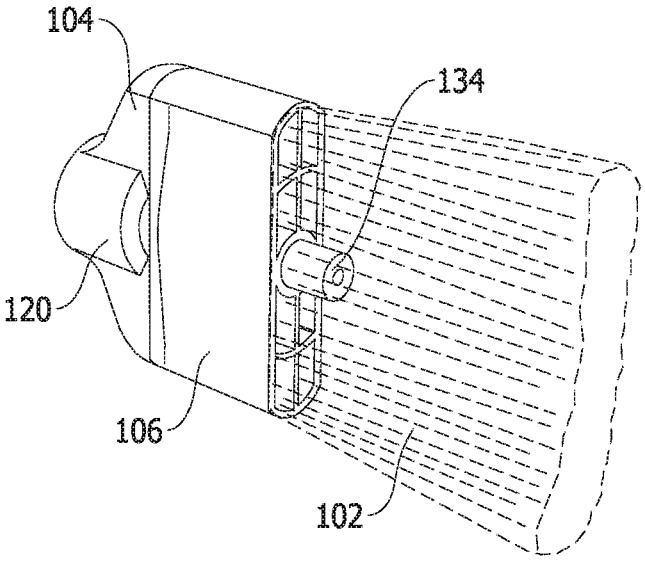
FIG. 4B illustrates a nozzle within bristles of a brush head for a dispensing paintbrush, according to an exemplary embodiment.

FIGS. 4A and 4B show views of the assembled brush head, with FIG. 4B showing the bristles transparently. As shown in FIGS. 3-4B, the nozzle 130 is disposed within the brush head 104 such that the narrow dispenser 134 protrudes from the brush head in among the bristles 102. In this embodiment, an end of the narrow dispenser is located at a position closer to the brush head 104 than to the tips of the bristles 102. This allows the dispensing paintbrush 100 to have the feel of a standard paintbrush during use. The nozzle body 132 fits within the brush head 104 opposite the narrow dispenser 134 as shown in FIG. 4A.

In some embodiments, the end of the narrow dispenser 134 may be adjacent the end of the brush head 104. In other instances, the end of the narrow dispenser 134 may be between the end of the brush head and approximately ⅛ of the length of the bristles from the brush head 104. In other embodiments, the end of the narrow dispenser 134 may be between ¼ or even up to ½ of the length of the bristles from the end of the brush head 104.

The paintbrush head 104 comprises a through hole 118 that accommodates the nozzle 130. Other apertures may also be included on the brush head 104 such as for receiving the bristles 102 in an epoxy or for decreasing the amount of material used in manufacturing.

Figure 5:
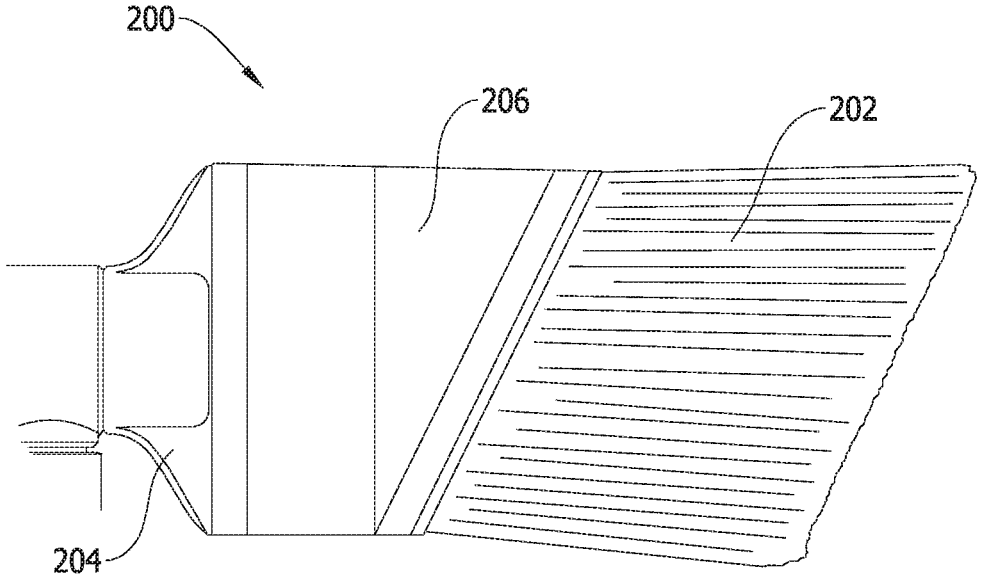
FIG. 5 illustrates a brush head for a dispensing paintbrush according to an exemplary embodiment.

A dispensing paint brush may take on many forms. For example, as shown in FIG. 5, the paintbrush may be angled dispensing paintbrush 200. The angled dispensing paintbrush 200 includes a paintbrush head 204 and ferrule 206 configured to receive bristles 202 having an angled edge. Paintbrushes with other ends and of various sizes may also be used. For example, bristle configurations that are rectangular, circular, ovoid, or other shaped may be used with the dispensing paintbrush described herein.

Figure 6:
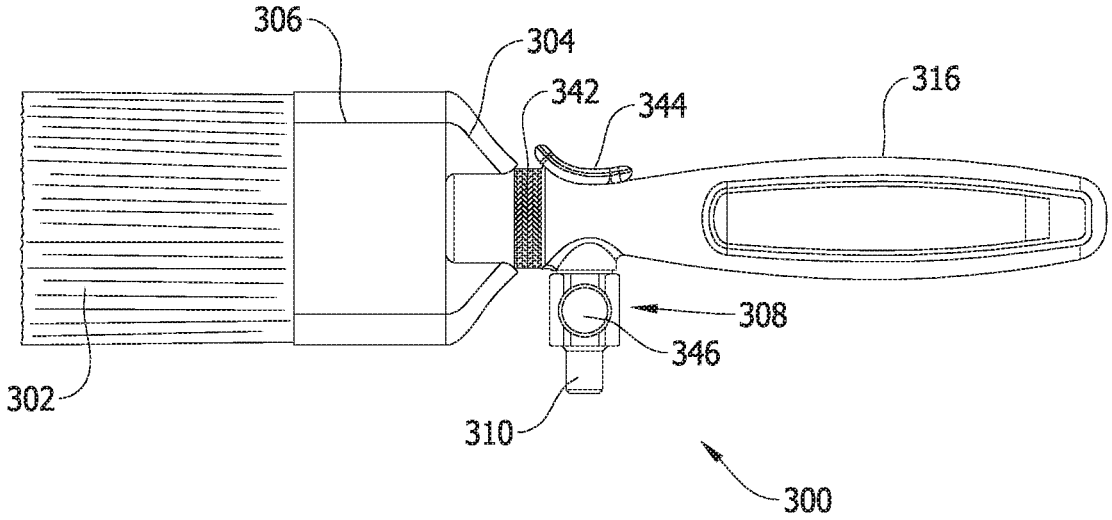
FIG. 6 illustrates a dispensing paintbrush according to another exemplary embodiment.

FIG. 6 shows a dispensing paintbrush according to another exemplary embodiment. In FIG. 6, a dispensing paintbrush 300 includes a brush head 304 and handle 316. Similar to brushes 100 and 200, the brush head 304 of the dispensing paintbrush 300 comprises a ferrule 306 and bristles 302. The brush head 304 may be removed and reattached as desired. The dispensing paintbrush 300 comprises a lock ring 342. The lock ring 342 is disposed on the handle to form an interface with the brush head 304. Specifically, the lock ring 342 may be used to attach and tighten the brush head 304 to the handle 316. Thus, when the brush head 304 is to be removed or reoriented relative to the handle 316, the lock ring 342 is actuated to be loosened to allow the removal or reorientation.

The handle 316 comprises an inlet couple 308. The inlet coupler 308 includes an attachment point 310 to attach the handle 316 to a paint source. The inlet coupler 308 further comprises a flow control valve 346. The flow control valve 346 may be actuated by the user to control the amount of paint entering the inlet coupler 308. As shown in FIG. 6, the flow control valve 346 may be in the form of a dial that may be twisted by the user to adjust the flow of paint entering the inlet coupler 308. In some embodiments, the dial may include demarcations that provide feedback to the user about the amount of paint flowing to the inlet coupler 308.

The handle 316 may further comprise a trigger or button 344 to start and stop the flow of paint from the inlet coupler 308 to the handle 316 and ultimately to the bristles 302 of the paintbrush head 304. In this embodiment, the trigger 344 is positioned opposite the inlet coupler 308. The trigger 344 may be biased outward, such as via a biasing member (e.g. a spring), into an off position. That is, the trigger 344 may be configured to remain in an off position to restrict any flow of paint through the handle 316 to the brush head 304 unless actuated by the user. The trigger 344 may be actuated to open and allow flow of the paint to the brush head 304 by pressing the trigger 344 against the biasing member into an open position.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A dispensing brush, comprising:

a handle;

a brush head connected to the handle;

bristles attached to the brush head, the bristles being configured to apply a fluid to a surface;

a coupler attached to the handle and configured to connect to a fluid source; and a nozzle attached to the coupler, the nozzle being configured to dispense the fluid to the bristles;

wherein the coupler is configured to freely rotate about the brush head;

wherein the brush head is connected to the handle via a pivoting connection allowing rotation of the handle relative to the brush head;

and, wherein the coupler is disposed between the bristles and the pivot connection.

2. The dispensing brush of claim 1, further comprising a ferrule surrounding first ends of the bristles to retain the bristles together.

3. The dispensing brush of claim 1, wherein the nozzle comprises a narrow dispenser, the narrow dispenser being disposed in the brush head.

4. The dispensing brush of claim 3, wherein the coupler comprises an attachment point that connects to the fluid source, the attachment point extending from the coupler in a direction substantially perpendicular to the direction of a longitudinal extension of the bristles of the brush.

5. The dispensing brush of claim 1, further comprising an actuated lock that is configured to selectively lock and unlock to allow and stop the rotation of the handle relative to the brush head.

* * * * *